US006945601B1

(12) United States Patent
Wu

(10) Patent No.: US 6,945,601 B1
(45) Date of Patent: Sep. 20, 2005

(54) MULTI-STAGE BACKREST ASSEMBLY

(76) Inventor: Yao-Chuan Wu, 1-1, Neipuzai, Daqi Cun, Min Xiung Hsiang Jiayi Hsien (TW)

( * ) Notice: Subject to any disclaimer, the term of this patent is extended or adjusted under 35 U.S.C. 154(b) by 0 days.

(21) Appl. No.: 10/951,097

(22) Filed: Sep. 27, 2004

Related U.S. Application Data

(63) Continuation-in-part of application No. 10/746,631, filed on Dec. 23, 2003, now Pat. No. 6,843,530.

(51) Int. Cl.[7] ..... A47C 7/44

(52) U.S. Cl. ..... 297/284.4; 297/284.1; 297/353; 297/410

(58) Field of Search ..... 297/284.1, 284.3, 297/284.4, 284.7, 353, 354.11, 391, 404, 297/408, 410

(56) References Cited

U.S. PATENT DOCUMENTS 3,059,971 A * 10/1962 Becker ..... 297/353
3,890,000 A * 6/1975 Easley ..... 297/284.4
4,732,423 A * 3/1988 Condon ..... 297/284.1
4,981,325 A * 1/1991 Zacharkow ..... 297/284.1
5,112,106 A * 5/1992 Asbjornsen et al. ..... 297/284.7
5,228,747 A * 7/1993 Greene ..... 297/284.3
5,505,520 A * 4/1996 Frusti et al. ..... 297/284.4
5,588,703 A * 12/1996 Itou ..... 297/284.4
5,704,689 A * 1/1998 Kim ..... 297/301.4
5,730,688 A * 3/1998 Prusick ..... 297/353
6,354,662 B1 * 3/2002 Su ..... 297/284.7
2002/0043841 A1 * 4/2002 Giacinto ..... 297/284.4

* cited by examiner

*Primary Examiner*—Peter R. Brown
(74) *Attorney, Agent, or Firm*—Alan D. Kamrath; Nikolai & Mersereau, P.A.

(57) ABSTRACT

A multi-stage backrest assembly for a chair includes a support frame, a back support mounted on the support frame, a head support mounted on the support frame, and a waist support pivotally mounted on the back support. Thus, the backrest assembly has a pivotable function so as to fit the curve of the user's body ergonomically, thereby providing a comfortable effect to the user. In addition, the locking tube of the crossbar of the back support is adjustably mounted on the respective support rod of the support frame, so that the back support is adjustably mounted on the support frame to adjust the height of the back support so as to fit users of different statures.

17 Claims, 5 Drawing Sheets

MULTI-STAGE BACKREST ASSEMBLY

CROSS-REFERENCES TO RELATED APPLICATIONS

The present invention is a continuation-in-part application of the U.S. Ser. No. 10/746,631 filed Dec. 23, 2003 now U.S. Pat. No. 6,843,530.

BACKGROUND OF THE INVENTION

1. Field of the Invention

The present invention relates to a multi-stage backrest assembly, and more particularly to a multi-stage backrest assembly for a chair.

2. Description of the Related Art

A conventional backrest for a chair has a fixed structure that cannot be adjusted so as to fit the curve of a user's body ergonomically, so that the user easily feels uncomfortable when seated on the chair during a long period of time.

SUMMARY OF THE INVENTION

In accordance with the present invention, there is provided a multi-stage backrest assembly, comprising:

a support frame;

a back support mounted on the support frame;

a head support mounted on the support frame; and a waist support pivotally mounted on the back support.

The primary objective of the present invention is to provide a multi-stage backrest assembly having a pivotable function so as to fit the curve of the user's body ergonomically, thereby providing a comfortable effect to the user.

Another objective of the present invention is to provide a multi-stage backrest assembly, wherein the locking tube of the crossbar of the back support is adjustably mounted on the respective support rod of the support frame, so that the back support is adjustably mounted on the support frame to adjust the height of the back support so as to fit users of different statures.

A further objective of the present invention is to provide a multi-stage backrest assembly, wherein the support bar of the head support is adjustably mounted on the support rack, so that the head frame is adjustably mounted on the support rack to adjust the height of the head support so as to fit users of different statures.

A further objective of the present invention is to provide a multi-stage backrest assembly, wherein when a user is rested on the backrest assembly, the back support supports the user's back, and the waist support supports the user's waist by the elastic effect of the elastic bar which provides a cushion force to the waist support so as to enhance the support effect of the waist support, so that the user feels more comfortable.

A further objective of the present invention is to provide a multi-stage backrest assembly, wherein the waist support is pivotable relative to the back support, so that the inclined angle of the waist support is adjustable so as to fit the user's requirement.

A further objective of the present invention is to provide a multi-stage backrest assembly, wherein the head frame of the head support is pivotable relative to the support bar, so that the inclined angle of the head frame of the head support is adjustable so as to fit the user's requirement.

Further benefits and advantages of the present invention will become apparent after a careful reading of the detailed description with appropriate reference to the accompanying drawings.

DETAILED DESCRIPTION OF THE INVENTION

Figure 1:
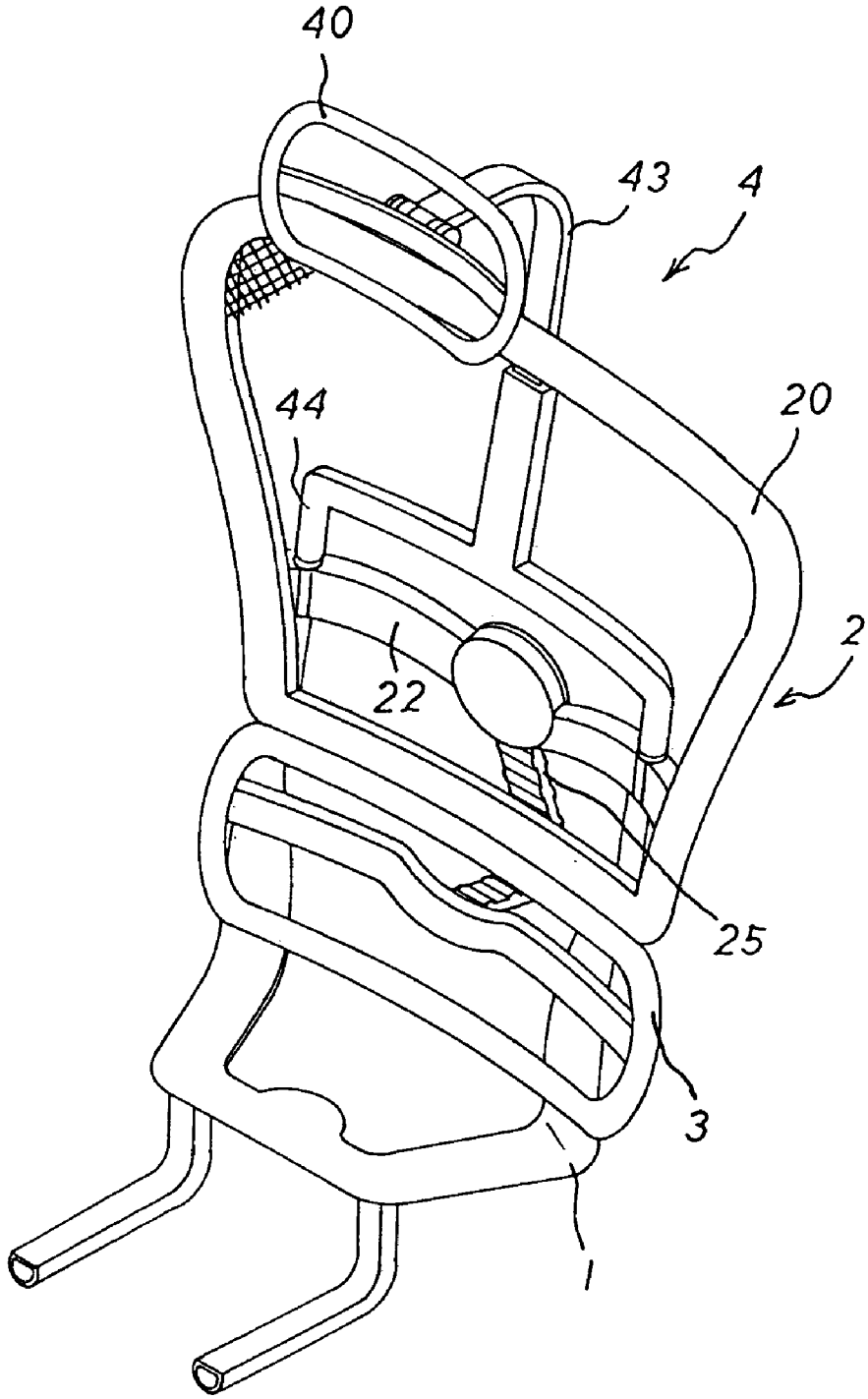
FIG. 1 is a perspective view of a multi-stage backrest assembly in accordance with the preferred embodiment of the present invention.
Figure 2:
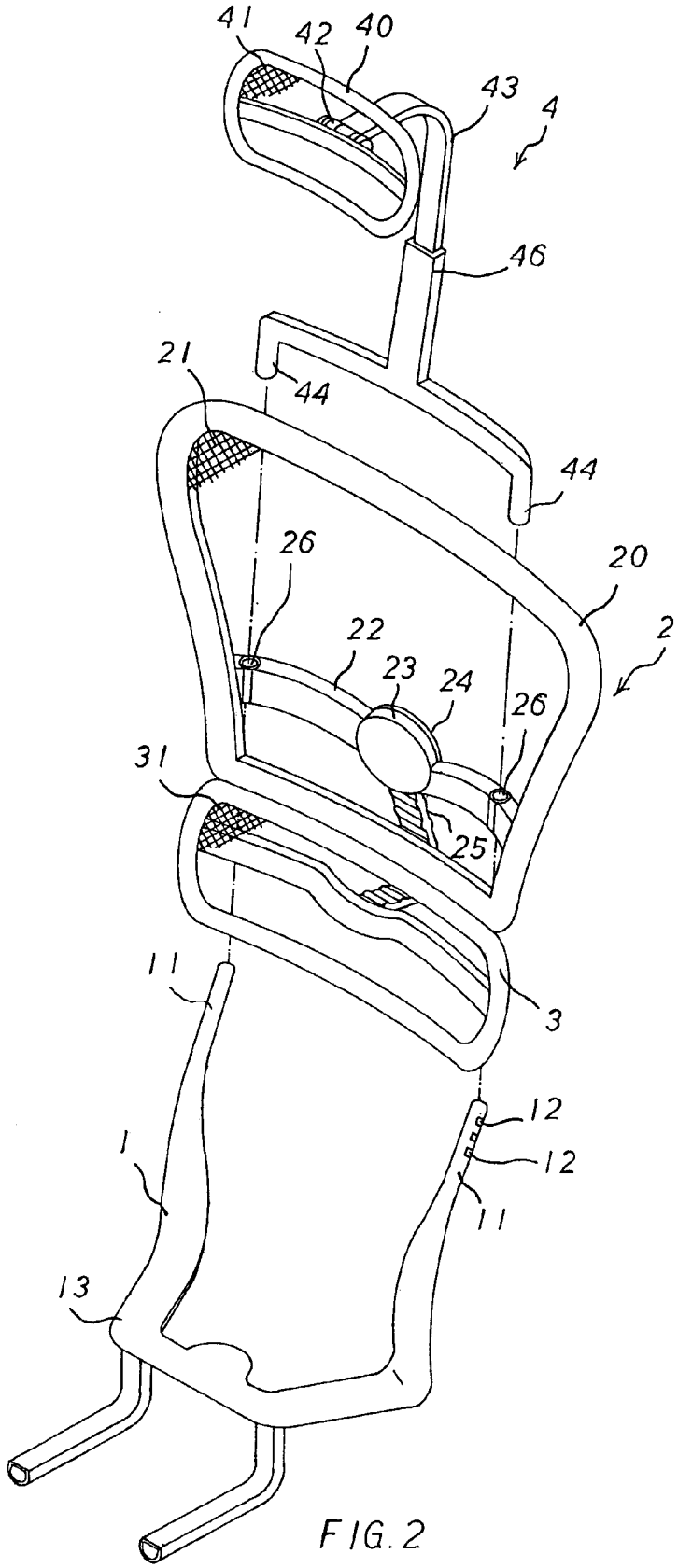
FIG. 2 is a partially exploded perspective view of the multi-stage backrest assembly as shown in FIG. 1.
Figure 3:
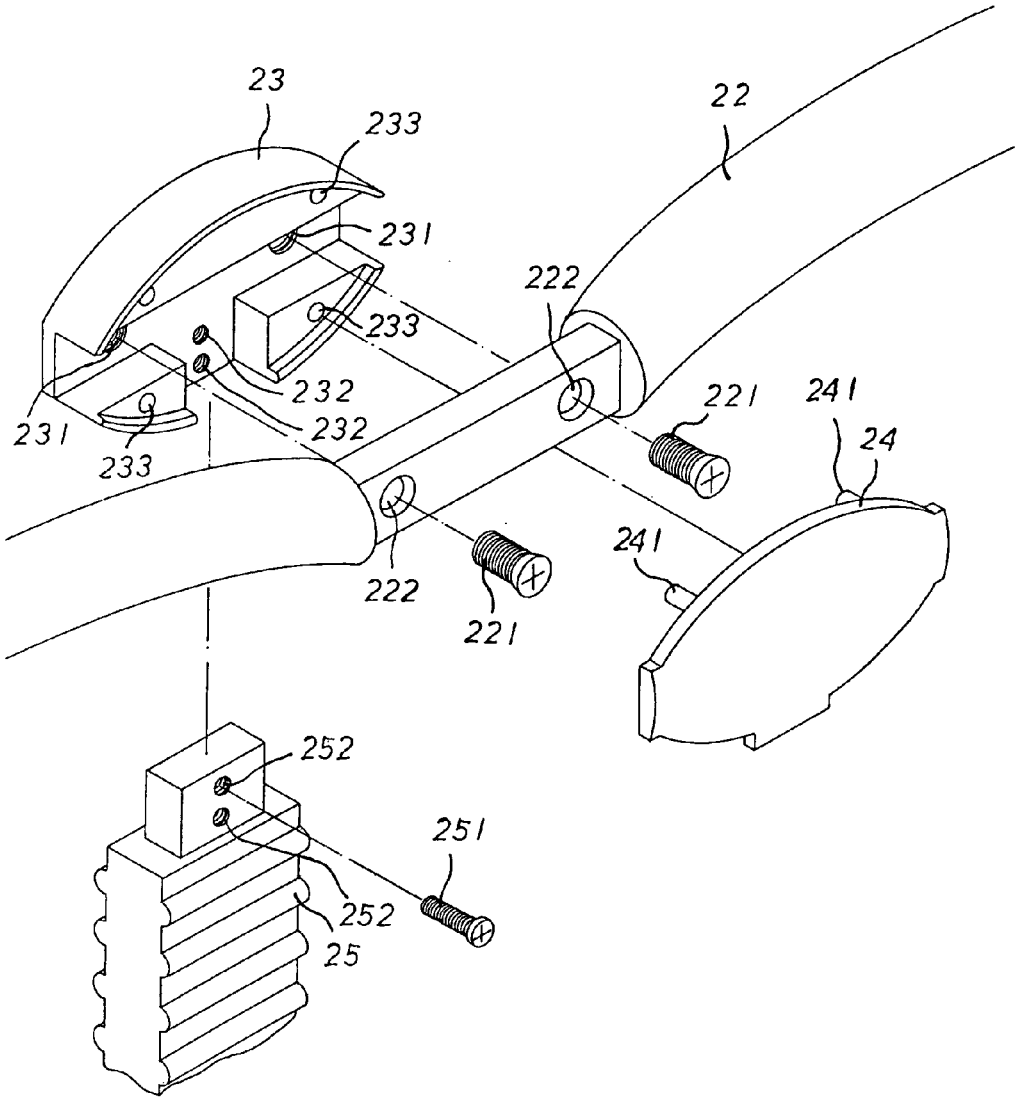
FIG. 3 is a partially exploded perspective view of the multi-stage backrest assembly as shown in FIG. 1.
Figure 4:
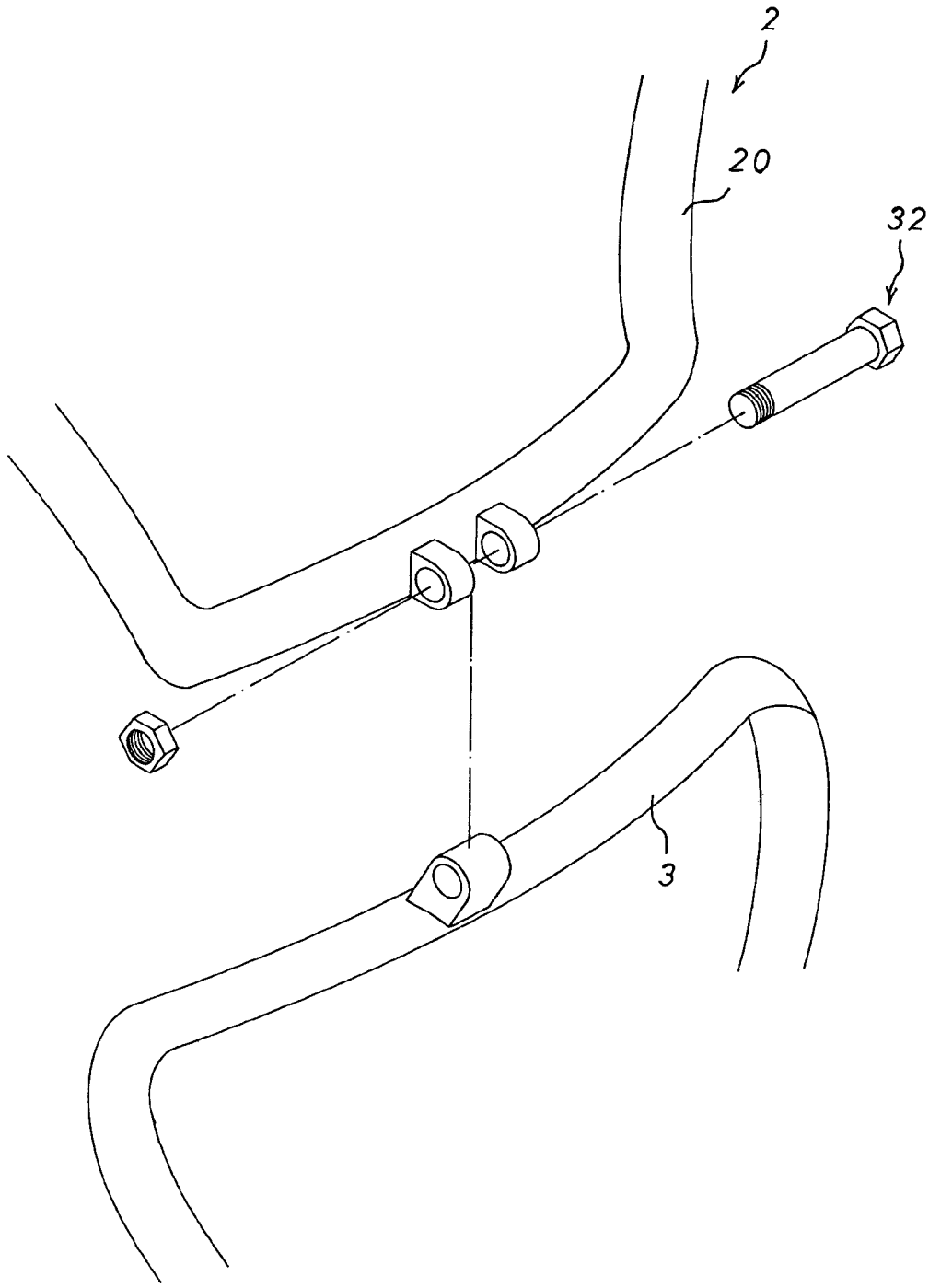
FIG. 4 is a partially exploded perspective view of the multi-stage backrest assembly as shown in FIG. 1.

Referring to the drawings and initially to FIGS. 1–4, a multi-stage backrest assembly for a chair in accordance with the preferred embodiment of the present invention comprises a support frame 1, a back support 2 mounted on the support frame 1, a head support 4 mounted on the support frame 1, and a waist support 3 pivotally mounted on the back support 2.

The support frame 1 is substantially U-shaped and has two substantially L-shaped sections each having a distal end formed with a support rod 11 formed with a plurality of locking holes 12. The support frame 1 has a mediate portion formed with a fixing portion 13 mounted on a seat (not shown), so that the multi-stage backrest assembly is mounted on the seat.

The back support 2 includes a backrest frame 20, a net 21 made of foam material or the like mounted on the backrest frame 20, and a crossbar 22 mounted in the backrest frame 20 and secured on the support frame 1.

The crossbar 22 of the back support 2 has two ends each formed with a locking tube 26 adjustably mounted on the respective support rod 11 of the support frame 1, so that the crossbar 22 of the back support 2 is secured on the support rods 11 of the support frame 1.

Figure 5:
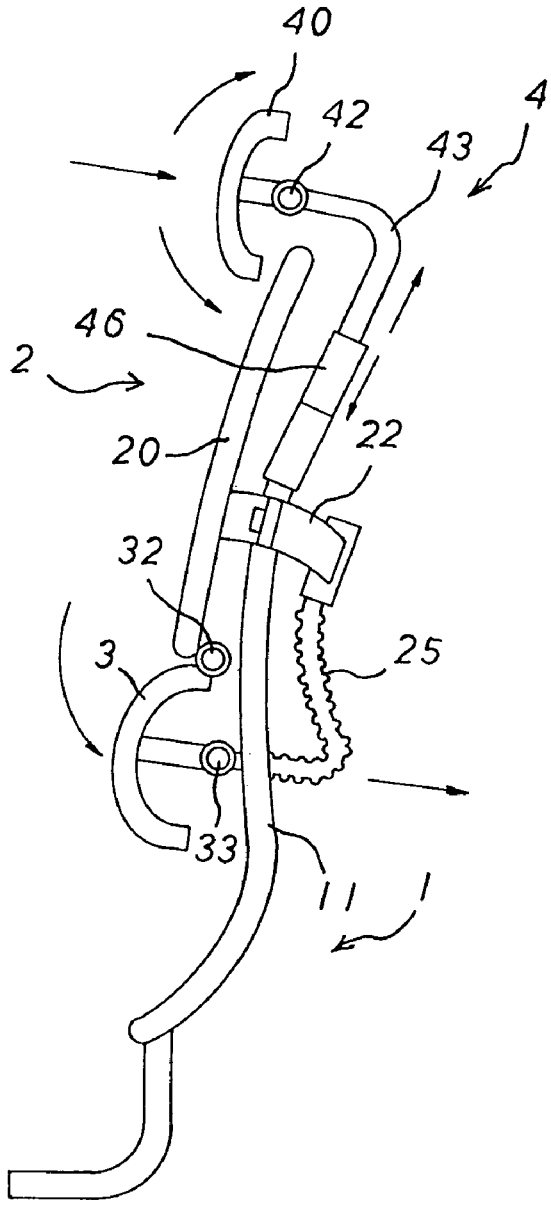
FIG. 5 is a side plan view of the multi-stage backrest assembly as shown in FIG. 1.

The back support 2 further includes a first cover 23 mounted on the crossbar 22, a second cover 24 mounted on the crossbar 22 and combined with the first cover 23, and a substantially V-shaped elastic bar 25 having a first end mounted between the first cover 23 and the second cover 24 and a second end pivotally mounted to the waist support 3 by a pivot member 33 (see FIG. 5). The elastic bar 25 has a corrugated face to enhance the elastic effect of the elastic bar 25.

The first cover 23 is formed with two screw bores 232, the first end of the elastic bar 25 is formed with two through holes 252, and the back support 2 further includes two locking screws 251 each extended through a respective one of the two through holes 252 of the elastic bar 25 and each screwed into a respective one of the two screw bores 232 of the first cover 23, so that the elastic bar 25 is fixed on the first cover 23.

The first cover 23 is formed with two screw holes 231, the crossbar 22 has a mediate portion formed with two through holes 222, and the back support 2 further includes two fixing screws 221 each extended through a respective one of the two through holes 222 of the crossbar 22 and each screwed into a respective one of the two screw holes 231 of the first cover 23, so that the first cover 23 is fixed on the crossbar 22.

The first cover 23 has a periphery formed with four positioning holes 233, and the second cover 24 has a periphery formed with four positioning tenons 241 each inserted into a respective one of the positioning holes 233 of the first cover 23, so that the second cover 24 is combined with the first cover 23.

The head support 4 includes a substantially inverted T-shaped support rack 46 having a lower end formed with two mounting tubes 44 each mounted on the respective support rod 11 of the support frame 1, a substantially inverted L-shaped support bar 43 adjustably mounted on the support rack 46 and having a lower end mounted on an upper end of the support rack 46, a head frame 40 pivotally mounted on an upper end of the support bar 43 by a pivot member 42, and a net 41 made of foam material or the like mounted on the head frame 40.

The waist support 3 is pivotally mounted on the back support 2 by a pivot member 32 (see FIG. 4) and is provided with a net 31 made of foam material or the like.

In operation, referring to FIGS. 1–5, the locking tube 26 of the crossbar 22 of the back support 2 is adjustably mounted on the respective support rod 11 of the support frame 1, so that the back support 2 is adjustably mounted on the support frame 1 to adjust the height of the back support 2 so as to fit users of different statures. In addition, the support bar 43 of the head support 4 is adjustably mounted on the support rack 46, so that the head frame 40 is adjustably mounted on the support rack 46 to adjust the height of the head support 4 so as to fit users of different statures. Further, when a user is rested on the backrest assembly, the back support 2 supports the user's back, and the waist support 3 supports the user's waist by the elastic effect of the elastic bar 25 which provides a cushion force to the waist support 3 so as to enhance the support effect of the waist support 3, so that the user feels more comfortable. Further, the waist support 3 is pivotable relative to the back support 2, so that the inclined angle of the waist support 3 is adjustable so as to fit the user's requirement. Further, the head frame 40 of the head support 4 is pivotable relative to the support bar 43, so that the inclined angle of the head frame 40 of the head support 4 is adjustable so as to fit the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A multi-stage backrest assembly, comprising:

a support frame;

a back support mounted on the support frame;

a head support mounted on the support frame; and a waist support pivotally mounted on the back support; wherein the back support includes a backrest frame, and a crossbar mounted in the backrest frame and secured on the support frame;

the back support further includes a first cover mounted on the crossbar, a second cover mounted on the crossbar and combined with the first cover, and an elastic bar having a first end mounted between the first cover and the second cover and a second end pivotally mounted to the waist support.

2. The multi-stage backrest assembly in accordance with claim 1, wherein the first cover is formed with two screw bores, the first end of the elastic bar is formed with two through holes, and the back support further includes two locking screws each extended through a respective one of the two through holes of the elastic bar and each screwed into a respective one of the two screw bores of the first cover, so that the elastic bar is fixed on the first cover.

3. The multi-stage backrest assembly in accordance with claim 1, wherein the first cover is formed with two screw holes, the crossbar has a mediate portion formed with two through holes, and the back support further includes two fixing screws each extended through a respective one of the two through holes of the crossbar and each screwed into a respective one of the two screw holes of the first cover, so that the first cover is fixed on the crossbar.

4. The multi-stage backrest assembly in accordance with claim 1, wherein the first cover has a periphery formed with a plurality of positioning holes, and the second cover has a periphery formed with a plurality of positioning tenons each inserted into a respective one of the positioning holes of the first cover, so that the second cover is combined with the first cover.

5. The multi-stage backrest assembly in accordance with claim 1, wherein the elastic bar is substantially V-shaped.

6. The multi-stage backrest assembly in accordance with claim 1, wherein the elastic bar is pivotally mounted to the waist support by a pivot member.

7. The multi-stage backrest assembly in accordance with claim 1, wherein the elastic bar has a corrugated face to enhance the elastic effect of the elastic bar.

8. The multi-stage backrest assembly in accordance with claim 1, wherein the back support further includes a net mounted on the backrest frame.

9. A multi-stage backrest assembly, comprising:

a support frame;

a back support mounted on the support frame;

a head support mounted on the support frame; and a waist support pivotally mounted on the back support; wherein the support frame has two substantially L-shaped sections each having a distal end formed with a support rod formed with a plurality of locking holes;

the head support includes a support rack having a lower end formed with two mounting tubes each mounted on the respective support rod of the support frame, a support bar adjustable mounted on the support rack and having a lower end mounted on an upper end of the support rack, and a head frame pivotally mounted on an upper end of the support bar.

10. The multi-stage backrest assembly in accordance with claim 9, wherein the back support includes a crossbar having two ends each formed with a locking tube adjustably mounted on the respective support rod of the support frame, so that the crossbar of the back support is secured on the support rods of the support frame.

11. The multi-stage backrest assembly in accordance with claim 9, wherein the support rack is substantially inverted T-shaped.

12. The multi-stage backrest assembly in accordance with claim 9, wherein the support bar is substantially inverted L-shaped.

13. The multi-stage backrest assembly in accordance with claim 9, wherein the head support further includes a net mounted on the head frame.

14. The multi-stage backrest assembly in accordance with claim 9, wherein the head frame is pivotally mounted on the upper end of the support bar by a pivot member.

15. The multi-stage backrest assembly in accordance with claim 1, wherein the waist support is pivotally mounted on the back support by a pivot member.

16. The multi-stage backrest assembly in accordance with claim 1, wherein the waist support is provided with a net.

17. The multi-stage backrest assembly in accordance with claim 1, wherein the support frame is substantially U-shaped.

* * * * *